US010011115B2

(12) United States Patent
Sasaki

(10) Patent No.: US 10,011,115 B2
(45) Date of Patent: Jul. 3, 2018

(54) LIQUID DISCHARGE APPARATUS AND NON-TRANSITORY COMPUTER READABLE MEDIUM STORING PROGRAM

(71) Applicant: Shino Sasaki, Kanagawa (JP)

(72) Inventor: Shino Sasaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/156,489

(22) Filed: May 17, 2016

(65) Prior Publication Data

US 2016/0339688 A1 Nov. 24, 2016

(30) Foreign Application Priority Data

May 18, 2015 (JP) ..... 2015-101144

(51) Int. Cl.
*B41J 2/165* (2006.01)

(52) U.S. Cl.
CPC ..... *B41J 2/16585* (2013.01); *B41J 2/16526* (2013.01)

(58) Field of Classification Search
CPC .... B41J 2/04581; B41J 2/0458; B41J 2/0451; B41J 2/04596; B41J 2/04586; B41J 2/16526; B41J 2/16508; B41J 2/16579; B41J 2/16511; B41J 2/16523; B41J 2/16505; B41J 2/16585; B41J 2/165
USPC ..... 347/9, 10, 14, 29–32, 34, 35
See application file for complete search history.

(56) References Cited

U.S. PATENT DOCUMENTS

| | | | | |
|---|---|---|---|---|
| 7,520,579 | B2 * | 4/2009 | Yoshida | B41J 2/04581 347/14 |
| 2008/0123117 | A1 | 5/2008 | Kimura et al. | |
| 2008/0150983 | A1 | 6/2008 | Sasaki | |
| 2011/0311293 | A1 * | 12/2011 | Yasuzaki | B41J 11/663 400/583 |
| 2013/0016162 | A1 | 1/2013 | Yasu et al. | |
| 2013/0063507 | A1 | 3/2013 | Sasaki | |
| 2015/0116400 | A1 | 4/2015 | Sasaki | |
| 2015/0231880 | A1 * | 8/2015 | Nagase | B41J 2/14 347/20 |

FOREIGN PATENT DOCUMENTS

| | | |
|---|---|---|
| JP | 2012-187744 | 10/2012 |
| JP | 2012-187791 | 10/2012 |
| JP | 2013-059875 | 4/2013 |

* cited by examiner

*Primary Examiner* — Jannelle M Lebron
(74) *Attorney, Agent, or Firm* — Cooper & Dunham LLP

(57) ABSTRACT

A liquid discharge apparatus includes a liquid discharge head and a dummy discharge controller. The liquid discharge head includes nozzles to discharge liquid onto a continuous medium. The dummy discharge controller controls a dummy discharge operation to discharge dummy discharge droplets onto the continuous medium. The dummy discharge controller controls the liquid discharge head to perform a pre-first-page dummy discharge operation to discharge dummy discharge droplets onto the continuous medium in a period from a start of feeding of the continuous medium to a start of printing of a first page.

11 Claims, 14 Drawing Sheets

LIQUID DISCHARGE APPARATUS AND NON-TRANSITORY COMPUTER READABLE MEDIUM STORING PROGRAM

CROSS-REFERENCE TO RELATED APPLICATION

This patent application is based on and claims priority pursuant to 35 U.S.C. § 119(a) to Japanese Patent Application No. 2015-101144, filed on May 18, 2015, in the Japan Patent Office, the entire disclosure of which is hereby incorporated by reference herein.

BACKGROUND

Technical Field

Aspects of this disclosure relate to a liquid discharge apparatus and a non-transitory computer readable medium storing a program to cause a computer to execute a control process.

Related Art

A liquid discharge apparatus to discharge liquid onto a continuous medium performs dummy discharge operation to discharge dummy discharge droplets for a purpose, other than a main purpose of the apparatus, that maintains and recovers conditions of nozzles of a liquid discharge head as a liquid discharge device. Examples of the continuous medium include rolled sheet of paper, continuous sheet of paper, continuous-form paper, web medium. Examples of dummy discharge include flushing and preliminary discharge.

SUMMARY

In an aspect of this disclosure, there is provided a liquid discharge apparatus includes a liquid discharge head and a dummy discharge controller. The liquid discharge head includes nozzles to discharge liquid onto a continuous medium. The dummy discharge controller controls a dummy discharge operation to discharge dummy discharge droplets onto the continuous medium. The dummy discharge controller controls the liquid discharge head to perform a pre-first-page dummy discharge operation to discharge dummy discharge droplets onto the continuous medium in a period from a start of feeding of the continuous medium to a start of printing of a first page.

In another aspect of this disclosure, there is provided a non-transitory computer readable medium storing a program to cause a computer to execute a process of controlling a liquid discharge head to perform a dummy discharge operation to discharge dummy discharge droplets onto a continuous medium. The process includes controlling the liquid discharge head to perform a pre-first-page dummy discharge operation to discharge dummy discharge droplets onto the continuous medium in a period from a start of feeding of the continuous medium to a start of printing of a first page.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
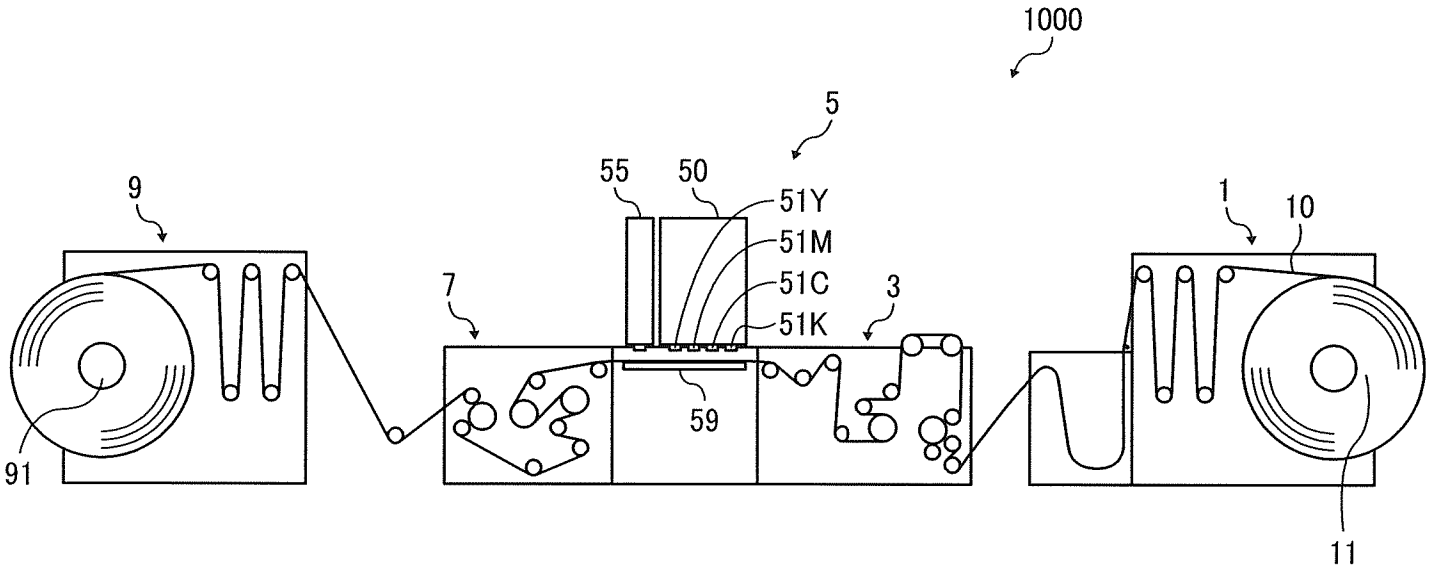
FIG. 1 is a side view of an example of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Referring now to the drawings, wherein like reference numerals designate identical or corresponding parts throughout the several views, exemplary embodiments of the present disclosure are described below. First, a liquid discharge apparatus 1000 according to an embodiment of this disclosure is described with reference to FIG. 1. FIG. 1 is an illustration of the liquid discharge apparatus 1000 according to this embodiment.

The liquid discharge apparatus 1000 includes a feeder 1 to feed a continuous medium 10, a guide conveyor 3 to guide and convey the continuous medium 10, fed from the feeder 1, to a printing unit 5, the printing unit 5 to discharge liquid onto the continuous medium 10 to form an image on the continuous medium 10, a drier unit 7 to dry the continuous medium 10, and an ejector 9 to eject the continuous medium 10.

The continuous medium 10 is fed from a root winding roller 11 of the feeder 1, guided and conveyed with rollers of the feeder 1, the guide conveyor 3, the drier unit 7, and the ejector 9, and wound around a winding roller 91 of the ejector 9.

In the printing unit 5, the continuous medium 10 is conveyed opposite a liquid discharge device 50 and a liquid discharge device 55 on a conveyance guide 59. The liquid discharge device 50 discharges liquid to form an image on the continuous medium 10. Post-treatment is performed on the continuous medium 10 with treatment liquid discharged from the liquid discharge device 55.

Here, the liquid discharge device 50 includes, for example, four-color full-line head units 51K, 51C, 51M, and 51Y (hereinafter, collectively referred to as "head units 51" unless colors are distinguished) from an upstream side in a feed direction of the continuous medium 10 (hereinafter, "medium feed direction") indicated by arrow D in FIG. 2.

The head units 51K, 51C, 51M, and 51Y are liquid discharge devices to discharge liquid of black (K), cyan (C), magenta (M), and yellow (Y) onto the continuous medium 10. It is to be noted that the number and types of color is not limited to the above-described four colors of K, C, M, and Y and may be any other suitable number and types.

Figure 2:
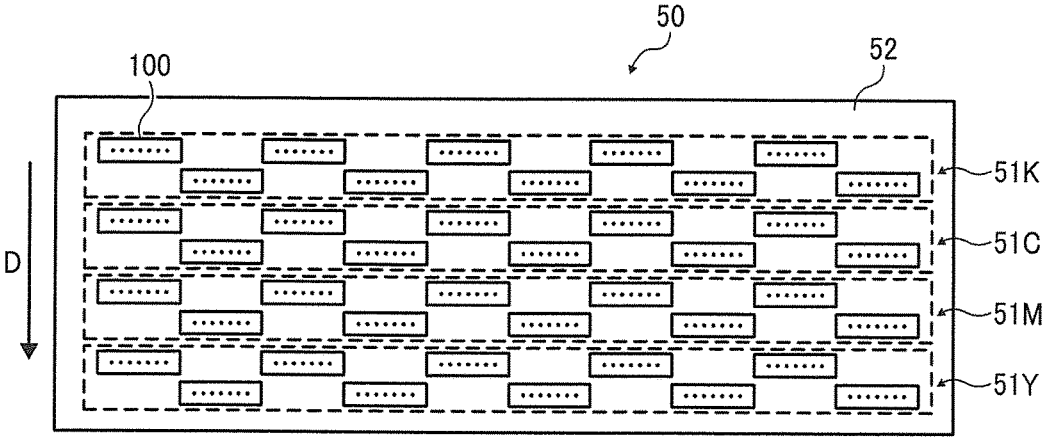
FIG. 2 is a plan view of a portion of a liquid discharge device according to an embodiment of the present disclosure.

In each head unit 51, for example, as illustrated in FIG. 2, a plurality of liquid discharge heads (also referred to as simply "heads") 100 are arranged in a staggered manner on a base 52 to form a head array. However, the configuration of the head unit 51 is not limited to such a configuration. In this embodiment, each head unit 51 includes a liquid discharge head unit including liquid discharge heads and head tanks to supply liquid to the liquid discharge heads. However, it is to be noted that the configuration of the head unit is not limited to such a configuration. Each head unit may be formed of, e.g., only the liquid discharge head(s).

Figure 3:
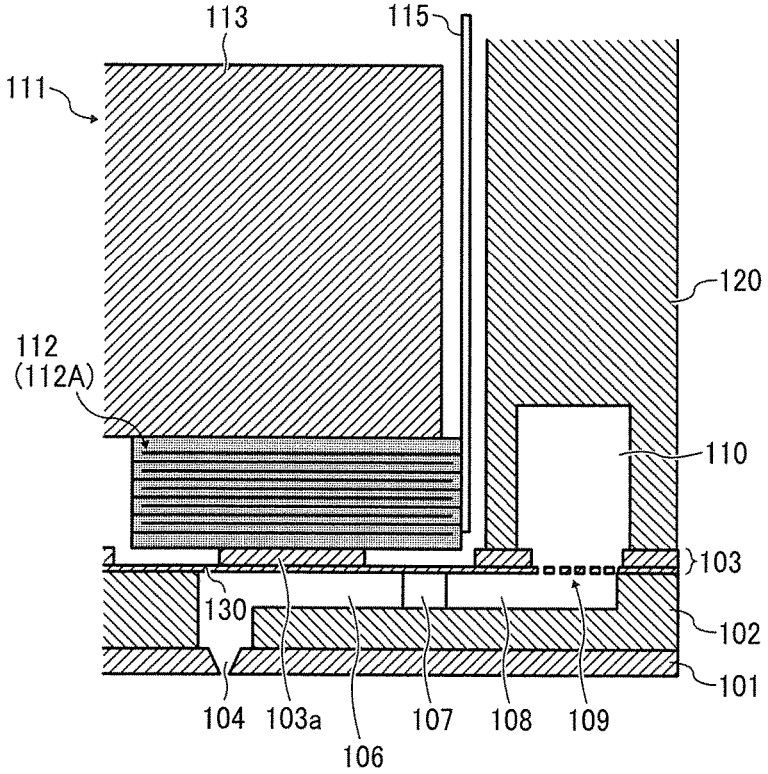
FIG. 3 is a cross-sectional view of an example of one liquid discharge head constituting part of a head unit according to an embodiment of the present disclosure, cut along a direction perpendicular to a nozzle array direction (i.e., a longitudinal direction of a liquid chamber)
Figure 4:
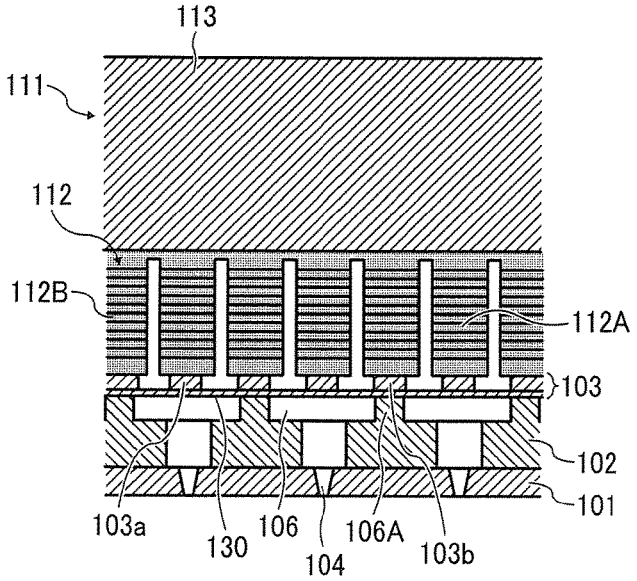
FIG. 4 is a cross-sectional view of the liquid discharge head of FIG. 3 cut along the nozzle array direction (the transverse direction of the liquid chamber)

Next, an example of one liquid discharge head constituting the head unit is described with reference to FIGS. 3 and 4. FIG. 3 is a cross-sectional view of the liquid discharge head cut along a direction (liquid-chamber longitudinal direction) perpendicular to a nozzle array direction. FIG. 4 is a cross-sectional view of the liquid discharge head cut along the nozzle array direction (liquid-chamber transverse direction).

In the liquid discharge head 100, a nozzle pate 101, a channel plate (liquid chamber substrate) 102, and a diaphragm plate 103 are bonded together. The liquid discharge head 100 includes piezoelectric actuator 111 to displace the diaphragm plate 103 and a frame 120 as a common channel member.

Thus, individual chambers (also referred to as pressure chambers or pressurizing chambers) 106 communicated with a plurality of nozzles 104 to discharge droplets, liquid supply passages 107 (also serving as fluid restrictors) to supply liquid to the individual liquid chambers 106, and liquid introduction portions 108 communicated with the liquid supply passages 107. Adjacent ones of the individual liquid chambers 106 are separated with a partition 106A.

Liquid is supplied from a common liquid chamber 110 as a common channel of the frame 120 to each individual liquid chamber 106 through a filter 109, the liquid introduction portion 108, and the liquid supply passage 107. The filters 109 are formed in the diaphragm plate 103.

The piezoelectric actuator 111 is disposed opposite the individual liquid chamber 106 with a deformable vibration region 130 interposed between the piezoelectric actuator 111 and the individual liquid chamber 106. The vibration region 130 constitutes part of a wall of the individual liquid chamber 106 of the diaphragm plate 103.

The piezoelectric actuator 111 includes a plurality of laminated piezoelectric members 112 bonded on a base 113. The piezoelectric member 112 is groove-processed by half cut dicing. Pillar-shaped piezoelectric elements (piezoelectric pillars) 112A and support pillars 112B are disposed at predetermined distances in a comb shape.

The piezoelectric elements 112A are bonded to island-shaped projections 103*a* in the vibration regions 130 of the diaphragm plate 103. The support pillars 112B are bonded to projections 103*b* of the diaphragm plate 103.

The piezoelectric member 112 includes piezoelectric layers and internal electrodes alternately laminated one on another. The internal electrodes are lead out to end faces to form external electrodes. A flexible printed circuit (FPC) 115 as a flexible wiring board is connected to the external electrodes of the piezoelectric element 112A to apply a drive waveform to the piezoelectric element 112A.

The frame 120 includes the common liquid chamber 110 to which liquid is supplied from the head tanks and liquid cartridges.

In the liquid discharge head 100, for example, when the voltage applied to the piezoelectric element 112A is lowered from a reference potential, the piezoelectric element 112A contracts. As a result, the vibration region 130 of the diaphragm plate 103 moves downward and the volume of the individual liquid chamber 106 increases, thus causing liquid to flow into the individual liquid chamber 106.

When the voltage applied to the piezoelectric element 112A is raised, the piezoelectric element 112A expands in the direction of lamination. The vibration region 130 of the diaphragm plate 103 deforms in a direction toward the nozzle 104 and contracts the volume of the individual liquid chamber 106. Thus, liquid in the individual liquid chamber 106 is pressurized and discharged (jetted) from the nozzle 104.

When the voltage applied to the piezoelectric element 112A is returned to the reference potential, the vibration region 130 of the diaphragm plate 103 is returned to the initial position and the individual liquid chamber 106 expands to generate a negative pressure. Accordingly, liquid is replenished from the common liquid chamber 110 to the individual liquid chamber 106 through the liquid supply passage 107. After the vibration of a meniscus surface of the nozzle 104 decays to a stable state, the liquid discharge head 100 shifts to an operation for the next droplet discharge.

Note that the driving method of the liquid discharge head is not limited to the above-described example (pull-push discharge). For example, pull discharge or push discharge may be performed in response to the way to apply the drive waveform.

Figure 5:
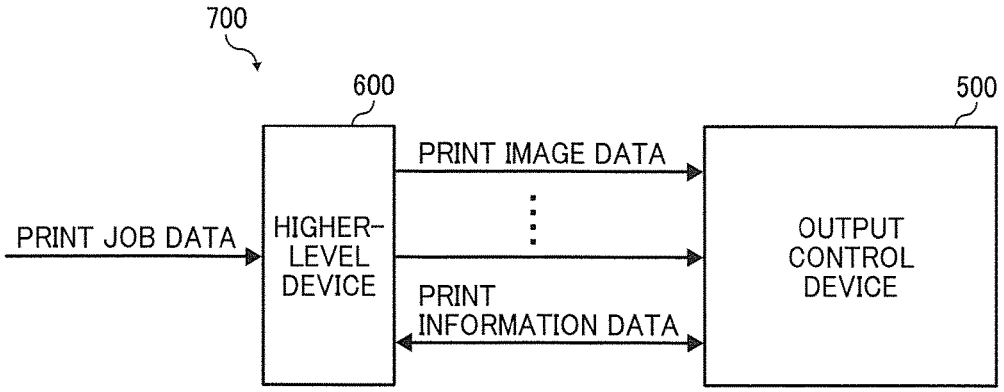
FIG. 5 is a block diagram of a control unit of the liquid discharge apparatus according to an embodiment of the present disclosure.
Figure 6:
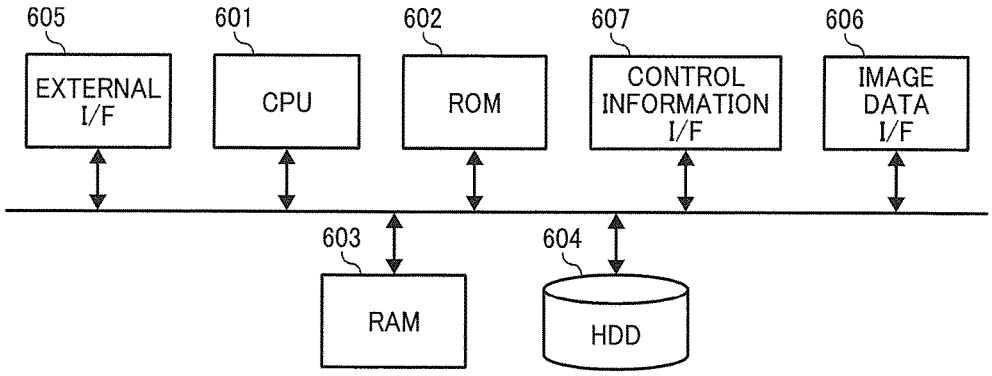
FIG. 6 is a block diagram of a higher-level device constituting the control unit of FIG. 5.
Figure 7:
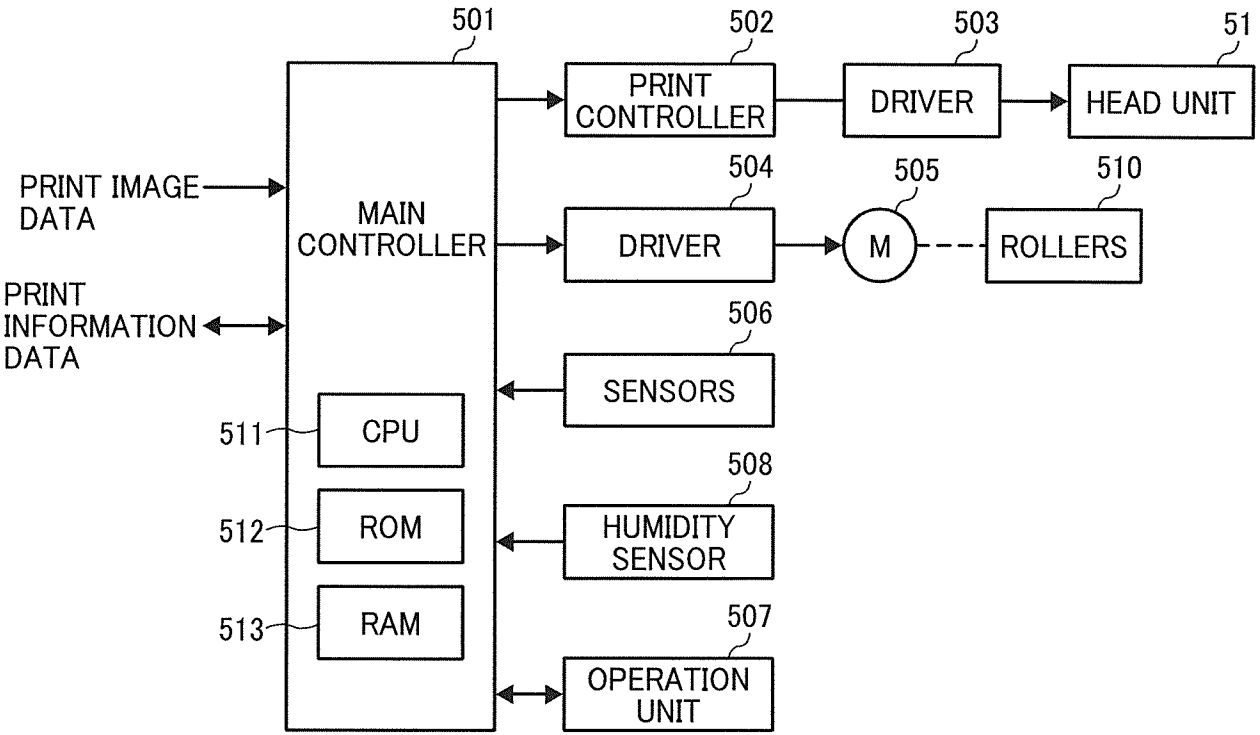
FIG. 7 is a block diagram of an output control device constituting the control unit of FIG. 5.

Next, a control unit of the liquid discharge apparatus according to an embodiment of the present disclosure is described with reference to FIGS. 5 through 7. FIG. 5 is a block diagram of the control unit according to the present embodiment. FIG. 6 is a block diagram of a higher-level device constituting part of the control unit. FIG. 7 is a block diagram of an output control device constituting part of the control unit.

The control unit 700 includes a higher-level device 600 and an output control device 500. The higher-level device 600 receives and processes print job data from a host device and transmits the processed data to the output control device 500. The output control device 500 receives print image data from the higher-level device 600 and performs print control.

The higher-level device 600 performs time-consuming processing with a raster image processor (RIP). The output control device 500 performs print processing.

The higher-level device 600 performs processing with the RIP based on the print job data (job data or print data) output from the host device. In other words, the higher-level device 600 creates print image data being bitmap data corresponding to respective colors, based on the print job data.

The higher-level device 600 creates control information data for controlling printing operation, based on, e.g., print job data and information of the host device. Here, the term "control information data" used herein includes data relating to print conditions (print mode, print type, information on sheet feeding and sheet ejection, the order of sheet faces to be printed, print sheet size, data size of print image data, resolution, paper type information, tone, color information, and print page count).

Here, as illustrated in FIG. 6, the higher-level device 600 includes, for example, a central processing unit (CPU) 601, a read only memory (ROM) 602, a random access memory (RAM) 603, a hard disk drive (HDD) 604, an external interface (I/F) 605, an image data I/F 606, a control information I/F 607.

The higher-level device 600 receives the print job data from the host device via the 10 external I/F 605 via the external I/F 605, creates bitmap data of YMCK colors, write the bitmap data onto the RAM 603, compresses and encodes the bitmap data, and stores the encoded data in the HDD 604.

Then, when printing operation is started, the higher-level device 600 decodes the encoded data, temporarily writes the decoded bitmap data onto the RAM 603, reads out the bitmap data, and transfers the bitmap data of respective colors as print image data toward the output control device 500 via the image data I/F 606.

The higher-level device 600 receives and transmits control information data from and to the output control device 500 via the control information I/F 607, in accordance with the progress of printing operation.

As illustrated in FIG. 7, the output control device 500 includes a main controller (system controller) 501 including, e.g., micro computers, such as a CPU 511, a ROM 512, a RAM 513, and input/output (I/O), an image memory, and a communication interface. The CPU 511 generally controls the entire output control device 500.

The main controller 501 transmits print image data to a print controller 502 to form an image on the continuous medium 10 in accordance with print image data and print information data transmitted from the higher-level device 600.

The print controller 502 transfers the image print image data received from the main controller 501 as serial data and outputs to a head driver 503, for example, transfer clock signals, latch signals, and control signals required for the transfer of print data and determination of the transfer.

The print controller 502 includes a drive waveform generator to output a driving waveform including one or more driving pulses to the head driver 503. The drive waveform generator includes, e.g., a digital/analog (D/A) converter, a voltage amplifier, and a current amplifier. The drive waveform generator performs digital/analog conversion on pattern data of a common driving pulse stored on an internal ROM.

In accordance with serially-inputted print image data corresponding to one head unit 51, the head driver 503 selects driving pulses of a driving waveform transmitted from the print controller 502 and applies the selected driving pulses to the piezoelectric element 112A as a pressure generator to discharge liquid. At this time, by selecting a part or all of the driving pulses forming the driving waveform or a part or all of waveform elements forming a driving pulse, the head unit 51 can selectively discharge dots of different sizes, e.g., large droplets, medium droplets, and small droplets.

The main controller 501 controls a motor 505 via a motor driver 504 to drive rollers 510 including, e.g., the root winding roller 11 of the feeder 1, the rollers of the feeder 1, the guide conveyor 3, the drier unit 7, and the ejector 9, the winding roller 91 of the ejector 9. Note that driving force is not necessarily applied to all of the rollers.

Detection signals from a humidity sensor 508 to detect an environmental humidity and the sensors 506 including various types of sensors are input to the main controller 501. The main controller 501 inputs and outputs various types of information and transmits and receives display information to and from an operation unit 507.

The main controller 501 is also a dummy discharge controller and controls dummy discharge operation to maintain or recover a state of the nozzles 104 by discharging dummy discharge droplets onto the continuous medium 10. The main controller 501 also performs control relating to dummy discharge operation including pre-first-page dummy discharge operation to discharge dummy discharge droplets onto the continuous medium 10 in a period from the start of feeding of the continuous medium 10 to the start of printing on a first page.

Figure 8:
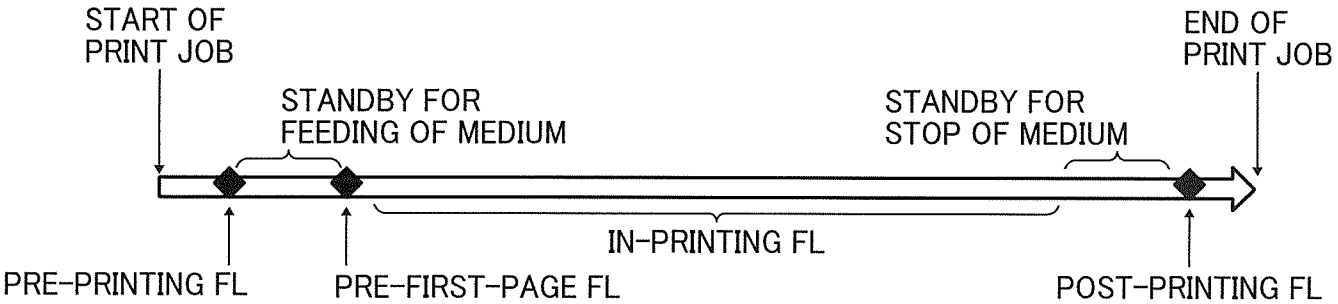
FIG. 8 is an illustration of a relationship between print control sequence and dummy discharge operation in a first embodiment of the present disclosure.
Figure 9:
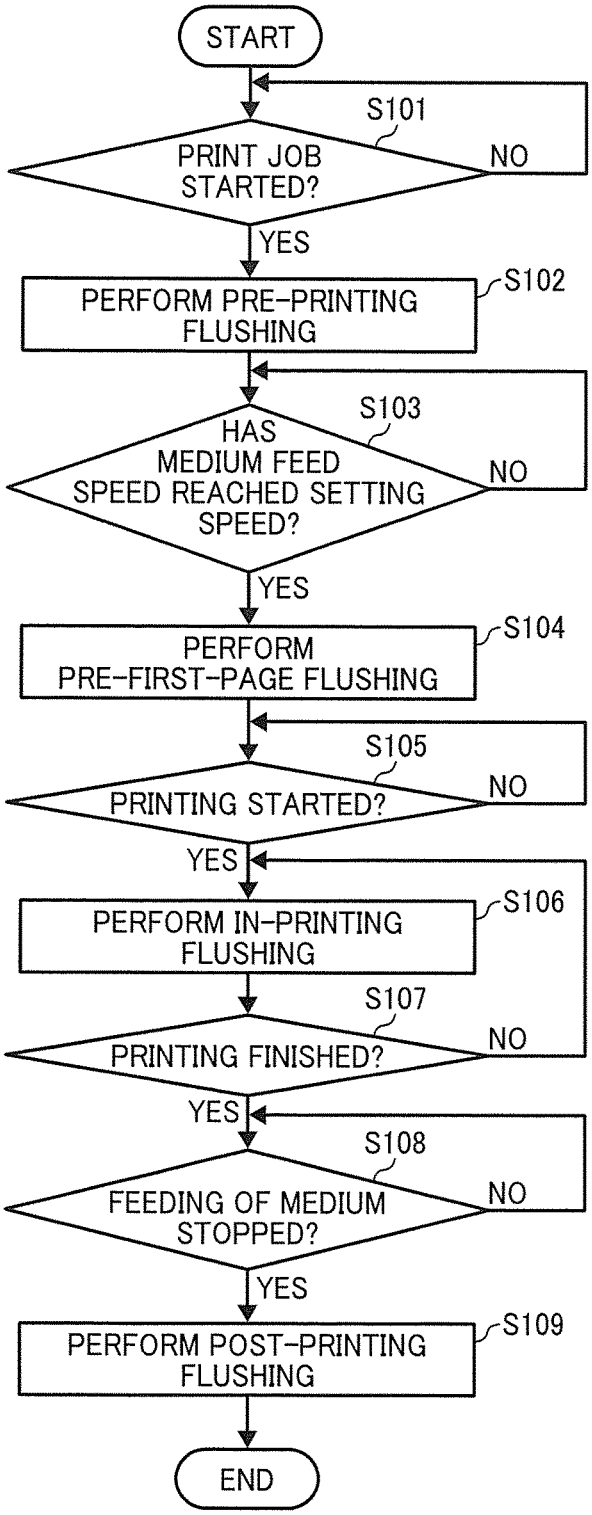
FIG. 9 is a flow chart of control of dummy discharge operation in the first embodiment.

Next, dummy discharge operation according to a first embodiment of the present disclosure is described with reference to FIGS. 8 and 9. FIG. 8 is an illustration of a relationship between print control sequence and dummy discharge operation in the first embodiment. FIG. 9 is a flow chart of control of dummy discharge operation in the first embodiment. Note that the term "FL" in FIG. 8 is an abbreviation of flushing.

When a print job is started (YES at S101), at S102 the main controller 501 performs pre-printing dummy discharge operation (pre-printing flushing) to cause the head 100 to discharge dummy discharge droplets into a cap capping the nozzle face of the head 100 In other words, in the pre-printing dummy discharge operation, the head 100 discharges dummy discharge droplets onto an area other than the continuous medium 10.

When the feeding speed of the continuous medium 10 reaches a setting speed (YES at S103), at S104 the main controller 501 performs pre-first-page dummy discharge operation (pre-first-page flushing) before the start of printing a first page. In the pre-first-page dummy discharge operation, dummy discharge droplets are discharged onto the continuous medium 10 fed. Hereinafter, as in this embodiment, pre-first-page dummy discharge (operation) performed before the start of printing of a first page after the feeding speed of the continuous medium 10 reaches a setting speed is referred to as "immediately-pre-first-page dummy discharge (operation)".

Then, after printing from the first page is started (YES at S105), at S106 in-printing dummy discharge operation (in-printing flushing) is performed. In the in-printing dummy discharge operation, dummy discharge droplets are discharged onto the continuous medium 10 fed. The in-printing dummy discharge operation includes line flushing operation as a first in-printing dummy discharge operation and star flushing operation as a second in-printing dummy discharge operation.

When printing is finished (YES at S107) and the feeding of the continuous medium 10 stops (YES at S108), at S109 the main controller 501 performs post-printing dummy discharge operation (post-printing flushing) to cause the head 100 to discharge dummy discharge droplets into a cap capping the nozzle face of the head 100.

As described above, when the feeding speed of the continuous medium 10 reaches the setting speed after the start of feeding of the continuous medium 10, pre-first-page dummy discharge (immediately-pre-first-page dummy discharge) to discharge dummy discharge droplets onto the continuous medium 10 is performed before the start of printing of a first page. Accordingly, normal discharge is performed from the first page, thus securing a normal image from the first page.

In other words, in the liquid discharge apparatus, when a print job is started, the head unit 51 is placed opposite the continuous medium 10 with the head 100 decapped and stands by until the feeding speed of the continuous medium 10 reaches a setting speed.

Accordingly, if it takes a long time before the feeding speed of the continuous medium 10 reaches the setting speed and printing is started, dry of liquid in the nozzles 104 of the head 100 proceeds. Thickening of Liquid in the nozzles 104 may hamper normal discharge. Hence, in this embodiment, dummy discharge operation is performed immediately before printing of the first page, thus securing normal discharge from the first page and enhancing image quality.

Next, line flushing operation and star flushing operation in in-printing dummy discharge operation is described with reference to FIGS. 10A and 10B.

In the liquid discharge apparatus 1000 according to this embodiment, the dummy discharge control unit (including programs) to control dummy discharge operation of the main controller 501 controls the first in-printing dummy discharge (referred to as line flushing) in which dummy discharge droplets land in line at constant intervals on the continuous medium 10 and the second in-printing dummy discharge (referred to as star flushing) in which less-recognizable fine droplets are scattered and landed on an image formation area of the continuous medium 10, as dummy discharge operation (flushing or preliminary discharge) during printing.

Figure 10A:
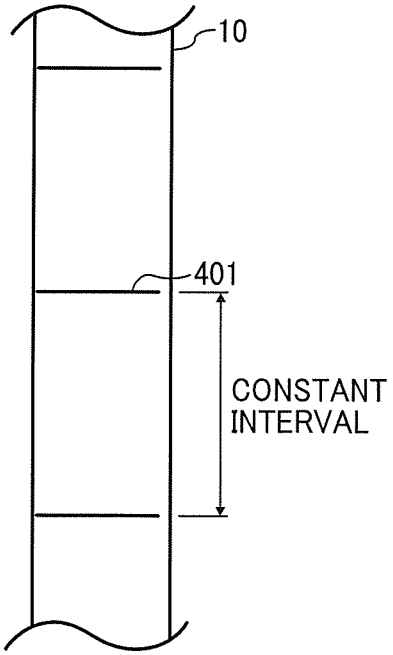
FIG. 10A is an illustration of a landed state of dummy discharge droplets on a continuous medium by line flushing (first in-printing dummy discharge) in in-printing dummy discharge operation.
Figure 10B:
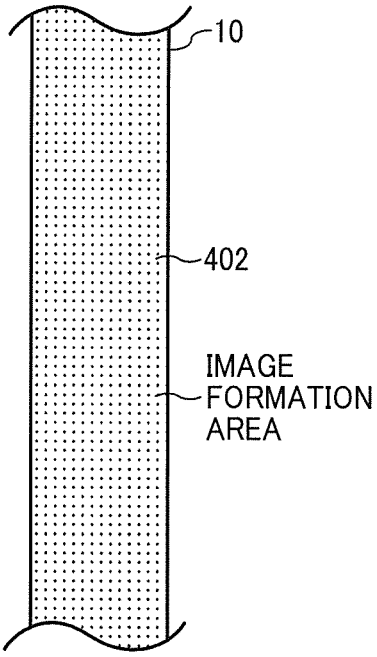
FIG. 10B is an illustration of a landed state of dummy discharge droplets on a continuous medium by star flushing operation in in-printing dummy discharge operation.

Here, for the line flushing operation, as illustrated in FIG. 10A, dummy discharge droplets 401 are discharged from all nozzles 104 and landed in line on the continuous medium 10. For the star flushing operation, as illustrated in FIG. 10B, fine dummy discharge droplets 402 are strewed like star and landed on the continuous medium 10.

Here, line flushing does not affect image quality in a printed page. However, a portion between pages on which dummy discharge droplets by line flushing are landed are a loss. By contrast, star flushing does not cause such a loss, but dummy discharge droplets might be recognized as background stains and affect image quality in a printed page.

For line flushing, since dummy discharge droplets are landed in areas between pages and do not affect image quality, the droplet speed can be increased without considering satellite droplets, thus enhancing recovery efficiency. By contrast, for star flushing, since dummy discharge droplets are landed on an image formation area and fine droplets used for image formation are also used as dummy discharge droplets, the speed and volume of dummy discharge droplets are less increased than line flushing.

Accordingly, for print conditions (e.g., low-humidity environment and low print speed) in which more intensive recovery operation is performed in immediately-pre-first-page dummy discharge, star flushing is selected as in-printing dummy discharge.

Figure 11A:
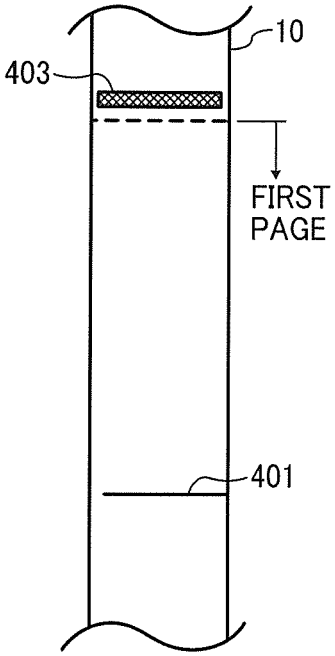
FIG. 11A is an illustration of an example of a landed state of dummy discharge droplets on a continuous medium by a combination of immediately-pre-first-page dummy discharge and line flushing as in-printing dummy discharge.
Figure 11B:
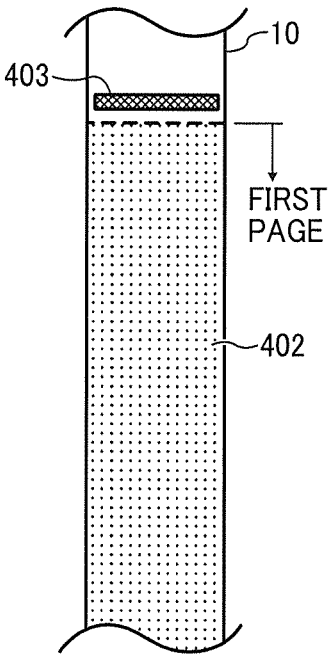
FIG. 11B is an illustration of an example of a landed state of dummy discharge droplets on a continuous medium by a combination of immediately-pre-first-page dummy discharge and star flushing as in-printing dummy discharge.

Next, examples of combinations of immediately-pre-first-page dummy discharge and in-printing dummy discharge are described with reference to FIGS. 11A and 11B. FIGS. 11A and 11B are illustrations of landed states of dummy discharge droplets on the continuous medium.

For an example of FIG. 11A, after dummy discharge droplets 403 are discharged in immediately-pre-first-page dummy discharge, print operation is started and line flushing operation is performed to land dummy discharge droplets 401 in line at constant intervals on the continuous medium 10.

For an example of FIG. 11B, after dummy discharge droplets 403 are discharged in immediately-pre-first-page dummy discharge, print operation is started. In in-printing dummy discharge operation, star flushing operation is performed to scatter and land dummy discharge droplets 402 on an image formation area.

Here, a range (a width in the medium feed direction D) in which dummy discharge droplets 403 are discharged in immediately-pre-first-page dummy discharge is wider than a range in which dummy discharge droplets 401 are discharged in line flushing operation. In other words, the number of times of flushing (the number of times of dummy discharge) in the medium feed direction is greater in immediately-pre-first-page dummy discharge than in line flushing operation as in-printing dummy discharge operation.

Accordingly, the nozzle state is more reliably maintained, thus securing normal discharge from a first page.

Note that immediately-pre-first-page dummy discharge is defined by the timing at which dummy discharge is performed, and does not limit usable dummy discharge pattern (landed pattern of dummy discharge droplets). Accordingly, dummy discharge pattern for immediately-pre-first-page dummy discharge or dummy discharge pattern for line flushing operation may be used as the dummy discharge pattern. In other words, as the immediately-pre-first-page dummy discharge, line flushing operation may be repeated multiple times or a single line flushing operation may be performed.

Figure 12:
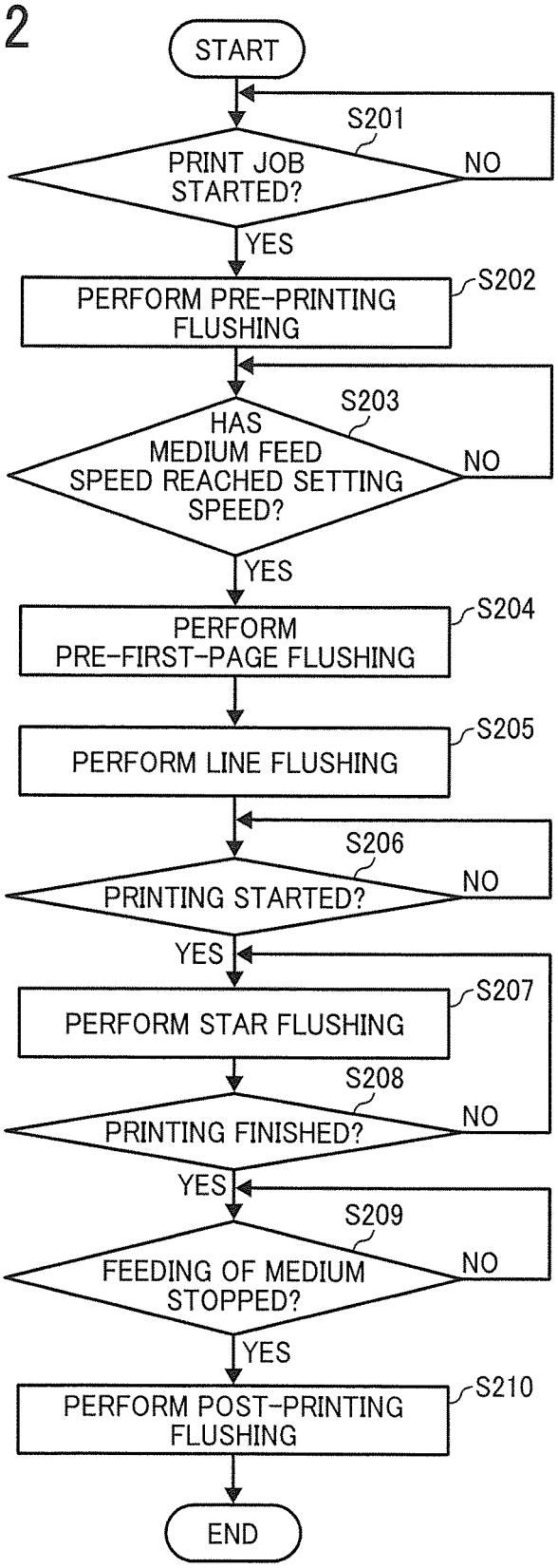
FIG. 12 is a flow chart of control of dummy discharge operation in a second embodiment of this disclosure.
Figure 13:
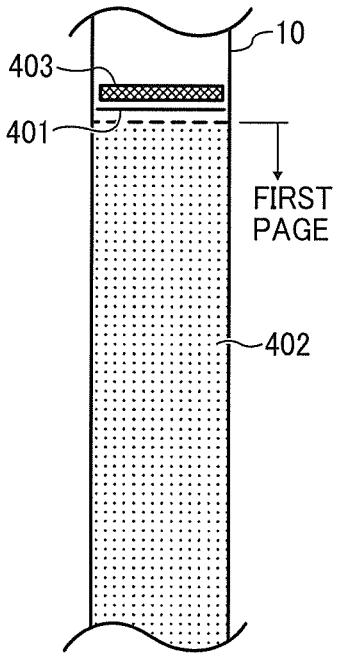
FIG. 13 is an illustration of an example of a landed state of dummy discharge droplets on a continuous medium in the second embodiment.

Next, a second embodiment of the present disclosure is described with reference to FIGS. 12 and 13. FIG. 12 is a flow chart of control of dummy discharge operation in the second embodiment. FIG. 13 is an illustration of a landed state of dummy discharge droplets on the continuous medium in the second embodiment. Steps S201 to S204 in FIG. 12 correspond to the steps S101 to S104 in FIG. 9 and steps S206 and S208 to S210 in FIG. 12 correspond to the steps S105 and S107 to S109, respectively, in FIG. 9. Therefore, redundant descriptions thereof are omitted below.

In this embodiment, in a case in which star flushing is selected as in-printing dummy discharge operation, immediately-pre-first-page dummy discharge is performed (S204) and then line flushing operation is performed (S205) as the dummy discharge operation in which dummy discharge droplets 401 are landed in line before the start of printing of a first page. After the printing of the first page is started (YES at S206), at S207 the start flushing is performed.

In other words, if only the star flushing operation is performed, thickened liquid might not be fully discharged. Therefore, before the start of printing of the first page, line flushing operation is performed (S205) to more reliably discharge thickened liquid, thus maintaining and recovering the nozzle state.

Figure 14:
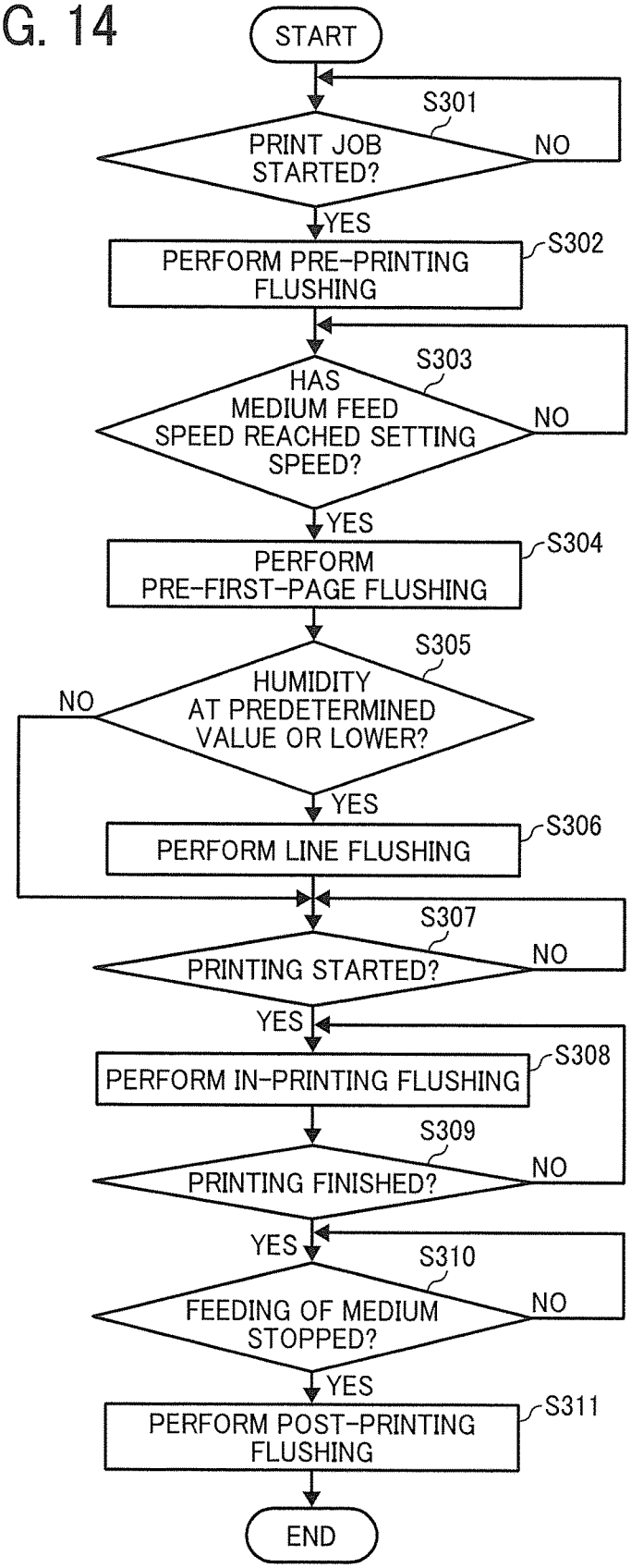
FIG. 14 is a flow chart of control of dummy discharge operation in a third embodiment of this disclosure.

Next, a third embodiment of the present disclosure is described with reference to FIG. 14. FIG. 14 is a flow chart of control of dummy discharge operation in the third embodiment. Steps S301 to S304 in FIG. 14 correspond to the steps S101 to S104 in FIG. 9 and steps S307 to S311 in FIG. 14 correspond to the steps S105 to S109, respectively, in FIG. 9. Therefore, redundant descriptions thereof are omitted below.

In this embodiment, when the environmental humidity is equal to or lower than a predetermined value (YES at S305), in addition to immediately-pre-first-page dummy discharge (S304), at S306 line flushing operation is performed as the dummy discharge operation in which dummy discharge droplets are landed in line before the start of printing of a first page.

In other words, as the environmental humidity is low, thickening of liquid is more likely to proceed. Therefore, before the start of printing of the first page, line flushing operation is performed to more reliably discharge thickened liquid, thus maintaining and recovering the nozzle state.

Figure 15:
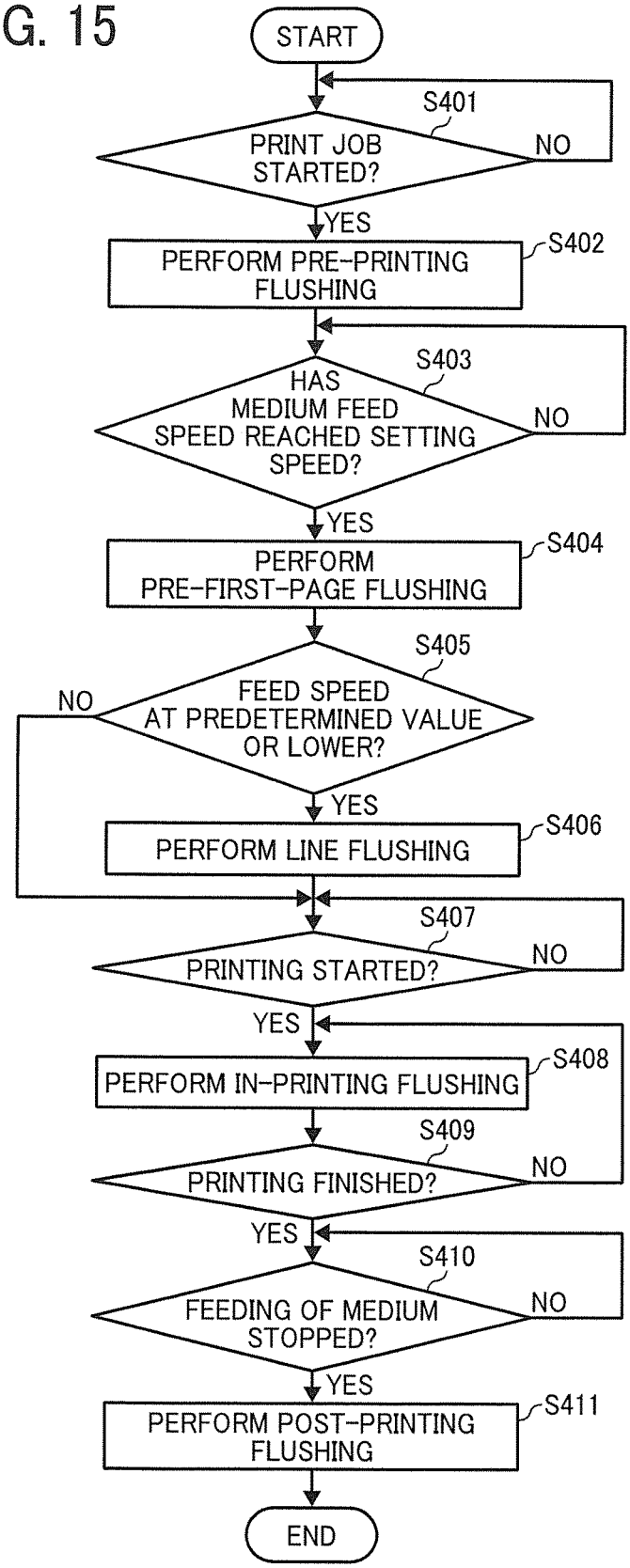
FIG. 15 is a flow chart of control of dummy discharge operation in a fourth embodiment of this disclosure.

Next, a fourth embodiment of the present disclosure is described with reference to FIG. 15. FIG. 15 is a flow chart of control of dummy discharge operation in the fourth embodiment. Steps S401 to S404 in FIG. 15 correspond to the steps S101 to S104 in FIG. 9 and steps S407 to S411 in FIG. 15 correspond to the steps S105 to S109, respectively, in FIG. 9. Therefore, redundant descriptions thereof are omitted below.

In this embodiment, when the feeding speed of the continuous medium 10 is equal to or less than a predetermined speed (YES at S405), in other words, when the printing speed is equal to or less than a predetermined speed, in addition to immediately-pre-first-page dummy discharge (S404), at S406 line flushing operation is performed as the dummy discharge operation in which dummy discharge droplets are landed in line before the start of printing of a first page.

In other words, as the feeding speed of the continuous medium 10 (the printing speed) is low, thickening of liquid is more likely to proceed before the start of printing of a first page. Therefore, before the start of printing of the first page, line flushing operation is performed in addition to immediately-pre-first-page dummy discharge operation to more reliably discharge thickened liquid, thus maintaining and recovering the nozzle state.

Note that, in the above-described second, third, and forth embodiments, line flushing operation in in-printing dummy discharge operation is performed as the dummy discharge operation for landing dummy discharge droplets in line, which is performed after pre-first-page dummy discharge operation and before the start of printing of the first page. However, the dummy discharge operation is not limited to line flushing operation. For example, as the above-described dummy discharge operation, a dummy discharge operation for landing dummy discharge droplets in line in a dummy discharge pattern different from the pattern in the line flushing operation as in-printing dummy discharge operation.

Figure 16:
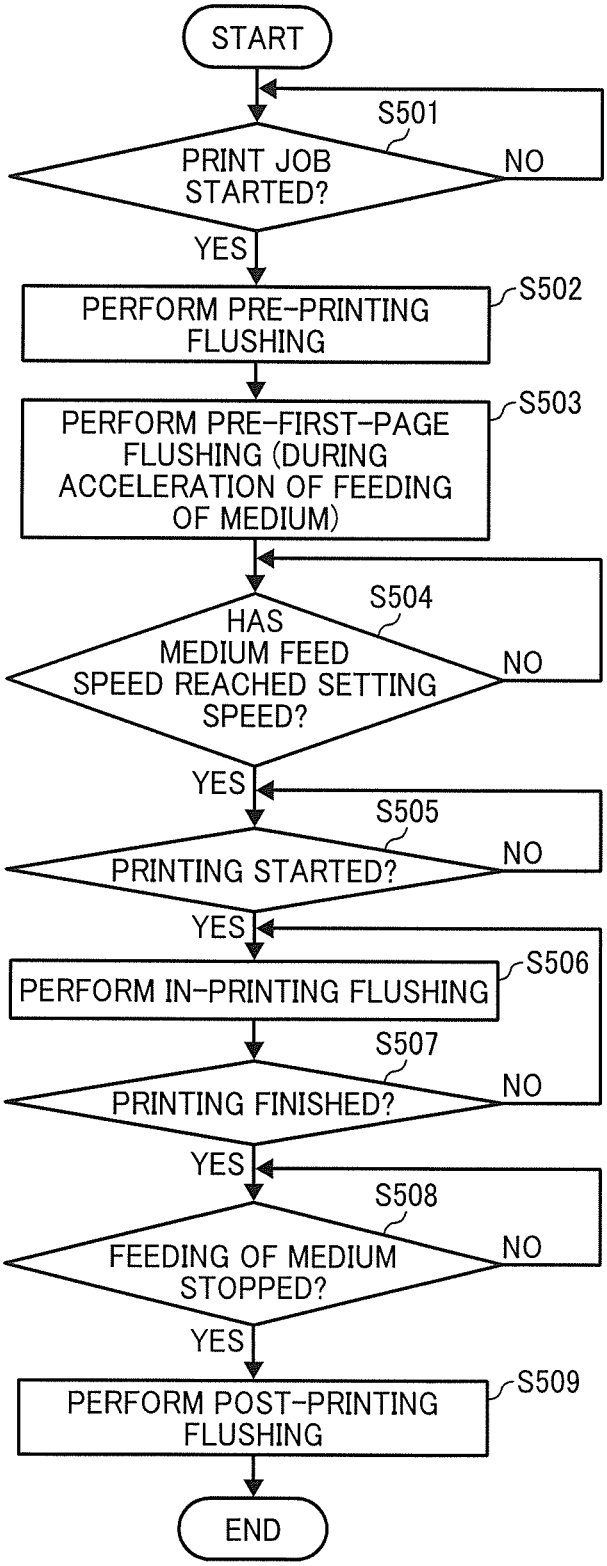
FIG. 16 is a flow chart of control of dummy discharge operation in a fifth embodiment of this disclosure.

Next, a fifth embodiment of the present disclosure is described with reference to FIG. 16. FIG. 16 is a flow chart of control of dummy discharge operation in the fourth embodiment. Steps S501 and S502 in FIG. 16 correspond to the steps S101 to S102 in FIG. 9 and steps S507 to S509 in FIG. 16 correspond to the steps S107 to S109, respectively, in FIG. 9. Therefore, redundant descriptions thereof are omitted below.

In this embodiment, at S503 pre-first-page dummy discharge operation is performed during acceleration in a period from the start of feeding of the continuous medium 10 to when the feeding speed of the continuous medium 10 reaches a setting speed. Then, when the feeding speed of the continuous medium 10 reaches a setting speed (YES at S504) and printing from the first page is started (YES at S505), at S506 in-printing dummy discharge operation (in-printing flushing) is performed.

Such a configuration allows the printing of a first page to be smoothly started after the feeding speed of the continuous medium 10 reaches the setting speed.

In addition, a discharge state is detected after pre-first-page dummy discharge operation is performed. When a defective nozzle is detected, pre-first-page dummy discharge operation may be repeated, thus allowing normal discharge to be more reliably performed from the first page.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus for performing an image forming operation to discharge liquid droplets to form a desired image, the apparatus comprising:

a liquid discharge head unit including nozzles that extends across a printing width to discharge liquid onto a continuous medium;

a conveyor to convey the continuous medium to the liquid discharge head unit; and a dummy discharge controller to control a dummy discharge operation to discharge dummy discharge droplets onto the continuous medium conveyed by the conveyor, the dummy discharge controller controlling the liquid discharge head unit to perform a pre-first-page dummy discharge operation to discharge dummy discharge droplets onto the continuous medium, in a period from a start of feeding of the continuous medium to a start of printing of an image of a first page onto the continuous medium, and wherein the dummy discharge controller controls the liquid discharge head unit to perform a first dummy discharge operation to land dummy discharge droplets in line onto the continuous medium before the printing of the first page is started after the pre-first-page dummy discharge operation is performed, and wherein the dummy discharge controller controls the liquid discharge head unit to perform a second dummy discharge operation to scatter and land dummy discharge droplets in an image formation area on the continuous medium during printing.

2. The liquid discharge apparatus according to claim 1, wherein the dummy discharge controller controls the liquid discharge head unit to perform the pre-first-page dummy discharge operation in the period from the start of feeding of the continuous medium to when a feeding speed of the continuous medium reaches a setting speed.

3. The liquid discharge apparatus according to claim 1, wherein the dummy discharge controller controls the liquid discharge head unit to perform the pre-first-page dummy discharge operation before the printing of the first page is started after a feeding speed of the continuous medium reaches a setting speed.

4. The liquid discharge apparatus according to claim 1, further comprising:

a humidity sensor to detect an environmental humidity and output an environmental humidity value, wherein the dummy discharge controller compares the environmental humidity value, output by the humidity sensor, to a predetermined value, and upon determining that the environmental humidity value is equal to or less than the predetermined value, the dummy discharge controller controls the liquid discharge head unit to perform the first dummy discharge operation to land the dummy discharge droplets in line onto the continuous medium before the printing of the first page is started after the pre-first-page dummy discharge operation is performed.

5. The liquid discharge apparatus according to claim 1, wherein, when a feeding speed of the continuous medium is equal to or less than a predetermined speed, the dummy discharge controller controls the liquid discharge head unit to perform the first dummy discharge operation to land the dummy discharge droplets in line onto the continuous medium before the printing of the first page is started after the pre-first-page dummy discharge operation is performed.

6. The liquid discharge apparatus according to claim 1, wherein the liquid discharge head unit includes a plurality of liquid discharge head units serially arrayed in a width direction of the continuous medium perpendicular to a feed direction of the continuous medium, each of the plurality of liquid discharge head units having the configuration of said liquid discharge head unit.

7. The liquid discharge apparatus according to claim 1, wherein the liquid discharge head unit includes a plurality of liquid discharge head units serially arrayed in a width direction of the continuous medium perpendicular to a feed direction of the continuous medium, each of the plurality of liquid discharge head units having the configuration of said liquid discharge head unit.

8. The liquid discharge apparatus according to claim 1, wherein the dummy discharge controller compares a feeding speed, at which the continuous medium is conveyed, to a predetermined speed, and upon determining that the feeding speed of the continuous medium is equal to or less than the predetermined speed, controlling the liquid discharge head unit to perform a line-flushing dummy discharge operation to land dummy discharge droplets in line onto the continuous medium after the pre-first-page dummy discharge operation is performed and before the start of printing of the first page.

9. The liquid discharge apparatus according to claim 1, wherein the liquid discharge head unit further includes a nozzle face, and the nozzles are disposed in the nozzle face, wherein the liquid discharge apparatus further comprises a cap to cover the nozzle face, and wherein the dummy discharge controller is configured to control the liquid discharge head unit (a) to perform a pre-printing flushing operation to discharge flushing droplets into the cap, before performing the pre-first-page dummy discharge operation.

10. A method performed by the liquid discharge apparatus according to claim 9, the method comprising:

discharging liquid from the nozzles of the liquid discharge head unit;

conveying the continuous medium to the liquid discharge head unit including the nozzles; and controlling the liquid discharge head unit (a) to perform the pre-printing flushing operation to discharge the flushing droplets into the cap and then (b) to perform the pre-first-page dummy discharge operation to discharge the dummy discharge droplets onto the continuous medium, in the period from the start of feeding of the continuous medium to the start of printing of the image of the first page onto the continuous medium.

11. A non-transitory computer readable medium storing a program to cause a computer to execute a process of controlling the liquid discharge head apparatus according to claim 1, to perform an image forming operation to form a desired image onto a continuous medium and to perform a dummy discharge operation to discharge dummy discharge droplets onto a continuous medium, the process comprising:

controlling the liquid discharge head unit (a) to perform a pre-printing flushing operation to discharge flushing droplets into a cap and then (b) to perform the pre-first-page dummy discharge operation to discharge the dummy discharge droplets onto the continuous medium, in the period from the start of feeding of the continuous medium to the start of printing of the image of the first page onto the continuous medium.

* * * * *